US010807790B2

(12) United States Patent
Slooff

(10) Patent No.: US 10,807,790 B2
(45) Date of Patent: Oct. 20, 2020

(54) RESEALABLE INNER PACKAGE FOR A CONTAINER

(71) Applicant: PHILIP MORRIS PRODUCTS S.A., Neuchatel (CH)

(72) Inventor: Arjen Hamilcar Slooff, Oosterbeek (NL)

(73) Assignee: Philip Morris Products S.A., Neuchatel (CH)

( * ) Notice: Subject to any disclaimer, the term of this patent is extended or adjusted under 35 U.S.C. 154(b) by 63 days.

(21) Appl. No.: 15/778,420

(22) PCT Filed: Nov. 11, 2016

(86) PCT No.: PCT/IB2016/056809
§ 371 (c)(1),
(2) Date: May 23, 2018

(87) PCT Pub. No.: WO2017/093831
PCT Pub. Date: Jun. 8, 2017

(65) Prior Publication Data

US 2018/0362247 A1 Dec. 20, 2018

(30) Foreign Application Priority Data

Nov. 30, 2015 (EP) ..... 15197090

(51) Int. Cl.
*B65D 85/10* (2006.01)

(52) U.S. Cl.
CPC .... *B65D 85/10568* (2020.05); *B65D 85/1027* (2013.01); *B65D 2575/586* (2013.01)

(58) Field of Classification Search
CPC ..... B65D 85/1045; B65D 85/1027; B65D 85/1018; B65D 75/5838; B65D 2575/586; A24F 15/12
See application file for complete search history.

(56) References Cited

U.S. PATENT DOCUMENTS 5,462,223 A * 10/1995 Focke ..... B05C 5/0212 229/160.1
6,164,444 A * 12/2000 Bray ..... B65D 75/5838 206/268

(Continued)

FOREIGN PATENT DOCUMENTS

| | | | |
|---|---|---|---|
| CN | 104114464 | A | 10/2014 |
| CN | 104724398 | A | 6/2015 |
| DE | 102010019867 | A1 | 9/2011 |
| EP | 0 944 539 | B1 | 3/2003 |

(Continued)

OTHER PUBLICATIONS

International Search Report and Written Opinion for PCT/IB2016/056809, issued by the European Patent Office as the International Preliminary Examining Authority, dated Jan. 31, 2017: 12 pgs.

(Continued)

*Primary Examiner* — Mollie Impink
(74) *Attorney, Agent, or Firm* — Mueting Raasch Group

(57) ABSTRACT

A container includes an inner package disposed within a housing. The inner package includes a first region that extends along a longitudinal axis of the inner package and includes first and second layers of a material that forms the inner package, and a second region adjacent the first region that also extends along the longitudinal axis. The second region includes only the first layer and not the second layer. The first region also includes a first line of weakness disposed in the first layer that defines a flap, and a second line of weakness disposed in the second layer that defines an access opening disposed in the first region. The access opening is covered by the flap when the flap is in a closed position and at least partially uncovered when the flap is in an open position.

20 Claims, 4 Drawing Sheets

(56) References Cited

U.S. PATENT DOCUMENTS

| | | | | |
|---|---|---|---|---|
| 2018/0111739 | A1* | 4/2018 | Tritz | B65D 75/5838 |
| 2018/0162631 | A1* | 6/2018 | Bray | B65D 75/5838 |

FOREIGN PATENT DOCUMENTS

| | | | |
|---|---|---|---|
| EP | 2 832 663 | A1 | 2/2015 |
| EP | 2544958 | B1 | 8/2016 |
| WO | WO 2008/142540 | A1 | 11/2008 |
| WO | WO 2009/095870 | A1 | 8/2009 |
| WO | WO 2011/009520 | A1 | 1/2011 |
| WO | WO 2011/018704 | A2 | 2/2011 |
| WO | WO 2011/110272 | A1 | 9/2011 |
| WO | WO 2013/120913 | A1 | 8/2013 |
| WO | WO 2013/120915 | A1 | 8/2013 |

OTHER PUBLICATIONS

Written Opinion of the International Preliminary Examining Authority,, issued by the European Patent Office as the International Preliminary Examining Authority, dated Oct. 30, 2017; 6 pgs.

International Preliminary Report on Patentability for PCT/IB2016/056809, issued by the European Patent Office as the International Preliminary Examining Authority, dated Feb. 13, 2018: 20 pgs.

Chinese Office Action for CN201680065945.9, issued by the Chinese Patent Office dated Apr. 23, 2019, including English Translation; 11 pgs.

Japanese Office Action issued by the Japanese Patent Office for JP Application No. 2018-526751, dated Aug. 17, 2020: 8 pgs. including English translation.

* cited by examiner

RESEALABLE INNER PACKAGE FOR A CONTAINER

This application is the § 371 U.S. National Stage of International Application No. PCT/IB2016/056809, filed 11 Nov. 2016, which claims the benefit of EP Patent Application No. 15197090.2, filed 30 Nov. 2015, the disclosures of which are incorporated by reference herein in their entireties.

The present invention relates to a container for consumer goods with a resealable inner package. The container finds particular application as a container for elongate smoking articles such as cigarettes.

Smoking articles such as cigarettes and cigars are commonly packaged in rigid hinge-lid containers having a box and a lid connected to the box about a hinge line extending across the rear wall of the container. Such hinge-lid containers are typically constructed from one-piece laminar cardboard blanks. In use, the lid is pivoted about the hinge line to open the container and so gain access to a bundle of smoking articles disposed within the box.

The bundle of smoking articles disposed within the box is typically wrapped in an inner liner of metalized paper, metal foil, or other flexible sheet material. To access the bundle of smoking articles within the inner liner, a consumer typically removes and discards a pre-perforated upper portion of the inner liner upon first opening the hinge-lid container.

However, to provide improved protection against the ingress and egress of, for example, air, moisture, flavors and odors, it is also known to enclose the bundle of smoking articles in a resealable, substantially airtight wrapper.

For example, European Patent Application EP-A-0 944 539 discloses a hinge-lid pack of smoking articles in which the smoking articles are enclosed in a sealed enclosure of a layer of barrier material having an access aperture defined therein. The access aperture is covered by a cover layer with a permanently tacky surface, which can be engaged with the layer of barrier material to reseal the enclosure after first opening the aperture. To aid opening and reopening of the sealed enclosure, a non-adhesive tab is provided at the bottom edge of the cover layer.

International Patent Application WO-A-2008/142540 discloses a hinge-lid pack of smoking articles in which the smoking articles are enclosed in an inner package with an extraction opening closed by a cover flap that is fixed to the inner package using non-dry re-stick adhesive applied to the underside of the cover flap. The inner or outer surface of a bottom tab of the cover layer is glued permanently and non-removably to an inner surface of the lid of the hinge-lid pack so that opening and closing the lid simultaneously also opens and closes the cover flap.

By way of further example, International Patent Application WO-A-2011/009520 discloses a pack for smoking articles that includes a sealed block as an inner pack and a hinge-lid box as an outer pack. The sealed block includes an operating tab formed by an inner blank or an outer layer of the inner blank and an opening tab formed on the inside as an additional material. The opening tab is moved into an open position with the aid of the operating tab and in the process exposes a removal opening in the region of an inner layer.

One object of the invention is to improve air tightness of one or more seals of an inner package of a container without requiring substantial modifications to machinery utilized to manufacture the inner package.

In one aspect of the present invention, a container for consumer goods is described. The container includes a housing including a box and a lid hingedly attached to the box, where the box includes a front wall and a rear wall. The container also includes an inner package disposed within the housing and at least partially defining an interior volume for housing consumer goods. The inner package is formed from a material that includes a first layer and a second layer attached to an inner surface of the first layer. The inner package also includes a first region that extends along the longitudinal axis of the inner package and includes the first and second layers. The first region also includes a first line of weakness disposed in the first layer that defines a flap, and a second line of weakness disposed in the second layer that defines an access opening disposed in the first region through which the consumer goods can be removed. The access opening is covered by the flap when the flap is in a closed position. Further, the access opening is at least partially uncovered when the flap is in an open position. The inner package also includes a second region adjacent the first region that extends along the longitudinal axis. The second region includes only the first layer and not the second layer.

In current seal constructions, the quality and functionality of the final pack depends on proper adhesion between the lid and the self-adhesive label, where the label has a complex construction or layout on both sides. In other words, a self-adhesive label that is attached to an outer surface of the inner package of the container is required to be releasably attached to the inner package. Such complex constructions can include a multilayer material that is utilized to form the inner package. This multilayer material, however, can be more challenging to seal together to form the inner package as multiple layers can increase a thickness of the material. For example, sealing together multiple layers of material can require additional energy and can increase the potential for gaps within the seal or seals formed within folds of the inner package. Further, such additional energy may damage the material of the inner package and slow down production of the final packs.

Various aspects of the present invention may have one or more advantages relative to currently-available or previously-described containers. For example, an inner package that includes a multilayer construction as described herein allows a user to unseal the package, access contents disposed within the package, and reseal the package. This multilayer construction can provide a more cost-effective manner in which to provide a sealed package that can be opened and closed to preserve the freshness of the package's contents. Further, the multilayer construction requires fewer elements while providing improved sealing properties of the container. The use of a multilayer construction only in regions or portions of the inner package that do not include folds can reduce the amount of material required to form the package, reduce the amount of energy required to seal such folds, and reduce gaps in such folds that can be formed when folding multilayer material. These and other advantages of various aspects of the present invention will be evident to those of skill in the art upon reading and understanding the present disclosure.

The present invention is applicable to any suitable container for consumer goods that includes an inner package. It is known to package consumer goods such as, for example, elongate smoking articles in containers formed from folded laminar blanks. For example, elongate smoking articles, such as cigarettes and cigars, are commonly sold in hinge-lid packs having a box for housing the smoking articles and a lid connected to the box about a hinge line extending across the back wall of the container. The box may include a box front wall, a box left side wall, a box right side wall, a box back wall, and a box bottom wall. The lid may include a lid front wall, a lid left side wall, a lid right side wall, a lid back wall, and a lid top wall.

The consumer goods within the container may be wrapped in an inner liner. The inner liner and consumer goods together form an inner package. The container can also include one or more inner frames disposed within the inner package, between the inner package and the box, or both within the inner package and between the inner package and the box. Prior to first opening, the filled container may be wrapped in an outer wrapper.

The container may take any suitable form for housing consumer goods. For example, as already mentioned, the container may be a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container, inner frame, inner package, and outer wrapper may be formed from any suitable materials including, but not limited to, cardboard, paperboard, plastic, metal, or combinations thereof. The cardboard may have a weight of between about 100 grams per square meter and about 350 grams per square meter.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof. For example, the container according to the invention may include, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the container includes one or more rounded edges, preferably the blanks forming the container include three, four, five, six, or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container includes one or more bevelled edges, preferably the bevelled edge has a width of between about 1 mm and about 10 mm, preferably between about 2 mm and about 6 mm. In one or more embodiments, the container may include a double bevel formed by three parallel creasing or scoring lines that are spaced such that two distinct bevels are formed on the edge of the container. Where the container includes a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

As well as housing a bundle of smoking articles, the container may further include other consumer goods, for example, matches, lighters, extinguishing means, breath fresheners, or electronics. Other consumer goods may be attached to the outside of the container, contained within the container along with the smoking articles, in a separate compartment of the container, or combinations thereof.

The lid of the housing is hingedly attached to the box and is adapted to be manipulated between an open position and a closed position. In the open position, the consumer can access the consumer goods disposed within the housing. The lid can be hingedly attached to the box along a hinge line that extends across a rear wall of the container. The term "hinge line" refers to a line about which the lid may be pivoted to open the container. A hinge line may be, for example, a fold line or a score line in the panel forming the back wall of the housing.

Disposed within the housing is an inner package that includes the consumer goods. The inner package at least partially defines an interior volume for housing consumer goods. Preferably, the inner package is formed from a material that includes a first layer and a second layer attached to the first layer. The inner package can be assembled using any suitable technique or combination of techniques. Preferably, the materials that form the inner package can be folded in any suitable manner to provide the desired shape. In one or more embodiments, the inner package can be formed such that it includes an envelope fold disposed in any suitable location, for example, on at least one of the top wall, bottom wall, front wall, back wall, and side walls of the inner package. The envelope fold can be formed using any suitable technique or combination of techniques and can be any suitable type of envelope fold. In one or more embodiments, the envelope fold can include one or more tabs that are folded over the inner package, where the tab that folds from the front wall of the inner package is typically folded over the tab that folds from the rear wall of the inner package. Two or more tabs of the fold can be attached together using any suitable technique or combination of techniques to provide a sealed portion. For example, the tabs can be attached together using an adhesive, ultrasonic welding, heat sealing, laser bonding, and combinations thereof. The inner package can include any suitable number of folds that can be located in any suitable location on the inner package once the package has been assembled. Preferably, the inner package includes an envelope fold on each of the first and second side walls such that each of the first and second side walls includes a sealed portion.

The first layer of the material that forms the inner package can include an inner surface and an outer surface. Further, the second layer of the material can include an inner surface and an outer surface. The second layer can be attached to the inner surface of the first layer using any suitable technique or combination of techniques. Preferably, the second layer is attached to the inner surface of the first layer using an adhesive. Any suitable adhesive or combination of adhesives can be utilized. Preferably, the adhesive is a releasable adhesive. Any suitable releasable adhesive can be utilized, for example, a pressure sensitive adhesive.

The first and second layers can include any suitable material or combination of materials. The first layer can include the same materials as the second layer or different materials than the second layer. Preferably, at least one of the first and second layers is formed of metal foil or metalized paper. At least one of the first and second layers may be formed as a laminate of a metalized polyethylene film and a liner material. At least one of the first and second layers can have a thickness that is between about 10 microns and about 50 microns. In addition, the first and second layers may be provided with a print-receptive top coating. One or both of the first and second layers can include a material or combination of materials that provide desired barrier properties to the inner package. The first layer can have the same barrier properties as the second layer or different barrier properties than the second layer.

Any suitable technique or combination of techniques can be utilized to form the first layer and the second layer. In one or more embodiments, at least one of the first layer and the second layer can be extruded. In one or more embodiments, the first and second layers can be coextruded. In one or more embodiments, one or both of the first and second layers can be oriented in one or both of a longitudinal direction and a transverse direction. In one or more embodiments, at least one of the first layer and the second layer can be cast and cured.

The inner package can include one or more regions disposed in any suitable relationship. The inner package can include a first region and a second region. In one or more embodiments, the first region extends along the longitudinal axis of the package and includes both the first and second layers. The first region can take any suitable shape or combination of shapes and have any suitable dimensions. Preferably, the first region has a width measured in a transverse direction of between about 2 mm and about 20 mm. The first region can also include a first line of weakness disposed in the first layer that defines a flap of the inner package. The first line of weakness can take any suitable shape or combination of shapes. Preferably, the first line of weakness defines a flap that has three sides that separate the flap from the first layer, and a fourth side that forms a hinge line between the flap and the first layer. In one or more embodiments, the flap can be attached to an inner surface of the lid of the box such that upon opening the lid the flap is separated from the inner package along the first line of weakness. In such embodiments, the flap can take any suitable shape when the lid is in the open position, for example, an S-shape. The flap can take any suitable shape or combination of shapes and have any suitable dimensions.

The first line of weakness can be continuous or discontinuous (for example, perforated). Further, the first line of weakness can be formed using any suitable technique or combination of techniques, for example, laser cutting or mechanical cutting (for example, die cutting or kiss cutting). The first line of weakness can include any suitable depth in a direction transverse to the inner and outer surfaces of the first layer. Preferably, the first line of weakness has a depth that is at least about 90 percent of a total thickness of the first layer. More preferably, the first line of weakness has a depth that is about 100 percent of the total thickness of the first layer. Any suitable percentage of material can remain along the first line of weakness after the line has been formed. Preferably, between about 5 percent and about 25 percent of material of the first layer remains along the first line of weakness after the line has been formed.

The first region can also include a second line of weakness formed in the second layer that defines an access opening disposed in the first region through which consumer goods can be removed. The access opening is covered by the flap formed in the first layer when the flap is in the closed position. Further, the access opening is at least partially uncovered when the flap of the first layer is in the open position. In one or more embodiments, the access opening is completely uncovered when the flap is in the open position. When the flap is in the open position, a portion of the second layer attached to the flap is separated from the inner package along the second line of weakness to reveal the access opening.

The second line of weakness can take any suitable shape or combination of shapes to define the access opening. The second line of weakness can be continuous or discontinuous (for example, perforated). Further, the second line of weakness can be formed using any suitable technique or combination of techniques, for example, laser cutting or mechanical cutting (for example, die cutting or kiss cutting). The second line of weakness can include any suitable depth in a direction transverse to the inner and outer surfaces of the second layer. Preferably, the second line of weakness has a depth that is about 90 percent of a total thickness of the second layer. More preferably, the second line of weakness has a depth that is about 100 percent of the total thickness of the second layer. Any suitable percentage of material can remain along the second line of weakness after the line has been formed. Preferably, between about 5 percent and about 25 percent of material of the second layer remains along the second line of weakness after the line has been formed.

The inner package also includes the second region adjacent the first region. The second region also extends along the longitudinal axis of the inner package. The second region can take any suitable shape or combination of shapes and have any suitable dimensions. Preferably, the second region has a width measured in a transverse direction of between about 2 mm and about 20 mm. In one or more embodiments, the second region includes only the first layer and not the second layer.

In one or more embodiments, the inner package can also include a third region adjacent the first region that extends along the longitudinal axis of the inner package. In such embodiments, the first region can be disposed between the second and third regions. The third region includes only the first layer and not the second layer. The third region can take any suitable shape or combination of shapes and have any suitable dimensions. Preferably, the third region has a width measured in a transverse direction of between about 2 mm and about 20 mm.

The second layer of the material that forms the inner package can extend over any suitable portion of the inner package when the inner package is in an assembled configuration. The second region preferably extends over the front wall of the assembled inner package and at least a portion of one or both of the first and second side walls. The second layer more preferably extends over the front wall of the assembled inner package and only a portion of one or both of the first and second side walls. In other words, the second layer of the material that forms the inner package can be present in any suitable portion or portions of the inner package when the inner package is in an assembled configuration. It may be preferred that the second layer does not extend into the sealed portion that is disposed in one or both of the first and second side walls.

At least a portion of the outer surface of the first layer can be permanently affixed to a corresponding portion of an inner surface of the rear wall of the box. Any suitable technique or combination of techniques can be utilized to affix this portion of the outer surface of the first layer to the rear wall of the box. Preferably, a permanent adhesive is utilized to attach the portion of the outer surface of the first layer to the rear wall of the box. Further, at least a portion of the outer surface of the first layer can be permanently affixed to a corresponding portion of an inner surface of the front wall of the box. Once again, any suitable technique or combination of techniques can be utilized to attach this portion of the outer surface of the first layer to the inner surface of the front wall of the box, for example, adhering the outer surface of the first layer to the inner surface of the front wall of the box with a permanent adhesive.

The flap defined by the first line of weakness can be attached to an inner surface of the lid of the housing of the container. Any suitable technique or combination of techniques can be utilized to attach the flap to the inner surface of the lid, for example, mechanical fasteners, adhesives, thermal or ultrasonic bonds, and combinations thereof. Preferably, the flap is attached to the inner surface of the lid using an adhesive. The adhesive can be any suitable adhesive or combination of adhesives. Preferably, the adhesive is a permanent adhesive. Any suitable portion of the flap can be attached to the inner surface of the lid. In one or more embodiments, a portion of the outer surface of the first layer that forms the flap is attached to the inner surface of the lid. In one or more embodiments, a portion of the inner surface of the first layer that forms the flap is attached to the lid.

The flap is adapted to reattach to the second layer when the flap is in the closed position. The same adhesive used to attach the second layer to the first layer can be disposed between the flap and the second layer to reattach the flap to the second layer when the flap is in the closed position. In one or more embodiments, an alternative or additional adhesive or adhesives can be disposed along at least a portion of the second layer along a periphery of the access opening such that the flap can be attached to the second layer when in the closed position. This portion of the second layer along the periphery of the access opening defines a seal region of the second layer. At least a portion of the seal region overlaps with the flap when the flap is in the closed position. The adhesive disposed between the flap and the second layer allows for repeated opening and closing of the flap such that the consumer goods disposed within the inner package can be accessed when the flap is in the open position, and so that the consumer goods remain sealed within the inner package when the flap is in the closed position. Preferably, the adhesive disposed between the flap and the second layer provides sufficient adhesion for the flap to be reattached at least as many times as there are consumer goods within the inner package such that the consumer can open and reseal the inner package until the package is empty.

Preferably, the flap can have an area that is greater than an area of the access opening of the inner package so that the access opening is covered by the flap when the flap is in the closed position. The first line of weakness that defines the flap exposes the seal region of the second layer. The seal region can have any suitable dimensions. For example, in one or more embodiments, the seal region can have a constant width that extends from a perimeter of the access opening to the first line of weakness. In one or more embodiments, the seal region can have a width that varies along the perimeter of the access opening. Preferably, an average width of the seal region is between about 2 mm and about 5 mm. Preferably, a surface area of the seal region is between about 25 percent and about 300 percent of an area of the access opening. More preferably, the surface area of the seal region is between about 25 percent to about 65 percent of the area of the access opening.

Preferably, the container can further include an adhesive label disposed over the flap defined in the first layer of the material that forms the inner package. The adhesive label can be attached to the first layer such that it covers the flap and can provide an additional seal so that both the flap and the label seal the access opening. In one or more embodiments, the adhesive label can be attached to the inner surface of the lid. In one or more embodiments, both the flap and the adhesive label can be attached to the inner surface of the lid.

In one or more embodiments, the inner package can include a decorative or informational adhesive label disposed on the outer surface of the first layer of the inner package. The adhesive label can include any suitable material or materials and can have any suitable dimensions. Further, the adhesive label can be disposed in any suitable location on the outer surface of the first layer. In one or more embodiments, the adhesive label can include indicia disposed on an outer surface of the label, and the label can be disposed in a location on the outer surface of the first layer such that the label can be viewed by a consumer.

The inner package may be more securely sealed along the first and second lines of weakness before the first opening of the container. This may increase the storage life of the consumer goods contained within the container.

The inner package can be formed from a preassembled inner package. The preassembled inner package can be formed from a material that includes the first layer and the second layer attached to the inner surface of the first layer. The first region can extend along the longitudinal axis and includes the first and second layers. The first region can include the first line of weakness disposed in the first layer that defines the flap and the second line of weakness disposed in the second layer that defines the access opening disposed in the first region. The access opening can be covered by the flap when the flap is in the closed position. Further, the access opening is at least partially uncovered when the flap is in the open position. The preassembled inner package can also include the second region adjacent the first region that extends along the longitudinal axis. The second region can include only the first layer and not the second layer. Preferably, the preassembled inner package also includes the third region adjacent the first region and that extends along the longitudinal axis. The first region is disposed between the second and third regions. The third region includes only the first layer and not the second layer. In one or more embodiments, the first region longitudinally extends an entire length of the preassembled inner package. In one or more embodiments, first region longitudinally extends between first and second transverse portions of the preassembled inner package. Each of the first and second transverse portions includes only the first layer and not the second layer. The first and second transverse portions can take any suitable shape or combination of shapes and have any suitable dimensions. The material of the preassembled inner package can include any suitable number of transverse portions.

The container can also include one or more inner frames disposed within the box. An inner frame can be disposed between the inner package and the front wall of the box or within the inner package. In one or more embodiments, a first inner frame can be disposed between the inner package and the front wall of the box and a second inner frame can be disposed within the inner package. When disposed within the inner package, the inner frame is positioned such that a front wall of the inner package is between the inner frame and the front wall of the box. The inner frame includes a front wall and a pair of opposed sidewalls. Preferably, the inner frame is U-shaped. The term "U-shaped" is used herein to refer to a shape that includes at least three parts, wherein the first part and the third part are parallel to each other and extend in the same direction perpendicular to the second part.

Preferably, the front wall of the inner frame is disposed such that the front wall of the inner package is between the front wall of the inner frame and the front wall of the box. Advantageously, an inner frame with a large surface area provided adjacent the front wall of the inner package increases the structural strength of the container. The increased structural strength provided by the inner frame allows the flap to be more securely closed. This is particularly advantageous for subsequent closing operations when the container is no longer full.

Preferably, the inner frame includes a cut-out at the top of the front wall. The cut-out preferably substantially corresponds to the access opening, and is provided such that the consumer goods within the inner package may be more easily accessed. Where the inner frame includes a cut-out, the height of the inner frame is defined as the distance from the bottom of the inner frame to the cut-out.

The inner frame may include one or more reinforcing elements. Preferably, the one or more reinforcing elements includes an adhesive such that the adhesive reinforces the inner frame and inner package. Alternatively, the one or more reinforcing elements may include at least one layer of material, such as a similar cardboard to that utilized for manufacturing the inner frame, affixed to the inner frame. In this alternative, the at least one further layer of material is permanently affixed to the inner frame. Preferably, the at least one further layer is elongate. Where the inner frame is U-shaped, the at least one further layer of material is preferably affixed to the outer surface of the front wall of the inner frame. Preferably, the at least one further layer is affixed adjacent the top of the inner frame.

A carton that includes a lid and at least one sidewall can contain multiple containers as described herein.

The phrase "adjacent the first region" means that one or both of the second region and third region is next to or adjoining the first region.

The terms "front," "back," "upper," "lower," "side," "top," "bottom," and other terms used to describe relative positions of the components of containers or inner packages refer to the container or inner package in an upright position with the lid at the top end and the consumer goods accessible from the upper end at the front. The terms "left" and "right" can be used with reference to side walls of the container or the inner package when the container and inner package are viewed from the front in its upright position.

The term "inner surface" is used herein to refer to the surface of a component of the assembled container that is facing towards the interior of the container, for example towards the consumer goods, when the container is in the closed position.

The term "longitudinal axis" is used herein to describe an axis of the inner package or pre-assembled inner package that extends between a top wall and a bottom wall of the inner package or pre-assembled inner package.

The term "outer surface" is used herein to refer to the surface of a component of the container that is facing towards the exterior of the container. For example, in one or more embodiments, the container includes an inner frame that includes an outer surface that is facing the outer housing of the container and an inner surface that is facing the inner package of the container.

All scientific and technical terms used herein have meanings commonly used in the art unless otherwise specified. The definitions provided herein are to facilitate understanding of certain terms used frequently herein.

Referring now to the drawings, in which some aspects of the present invention are illustrated:

Figure 1:
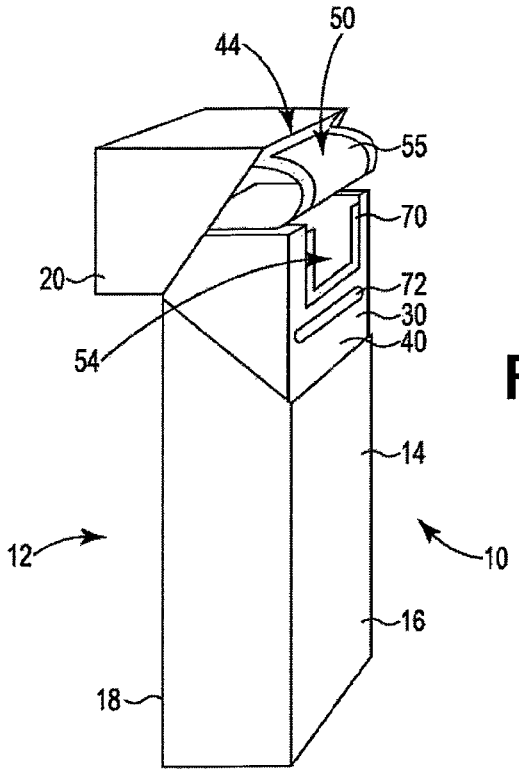
FIG. 1 is a schematic perspective view of a container that includes a lid in an open position, where the container includes a housing and an inner package disposed within the housing.

Referring to FIG. 1, a schematic perspective view of an embodiment of a container 10 for consumer goods is depicted. The container includes a housing 12 that includes a box 14 and a lid 20 hingedly attached to the box via a hinge line (not shown). The hinge line extends across a back 18 of the box 14 of the container 10 and acts to allow the lid 20 to be moved from a closed position (FIG. 3) to an open position as shown in FIG. 1. An inner package 30 is disposed within the housing 12. The inner package 30 at least partially defines an interior volume for housing consumer goods. The inner package 30 is made from a barrier material or materials to hermetically seal the consumer goods before the container is opened for the first time. The barrier material may be a metal foil or a plastic and metal laminate.

Figure 3:
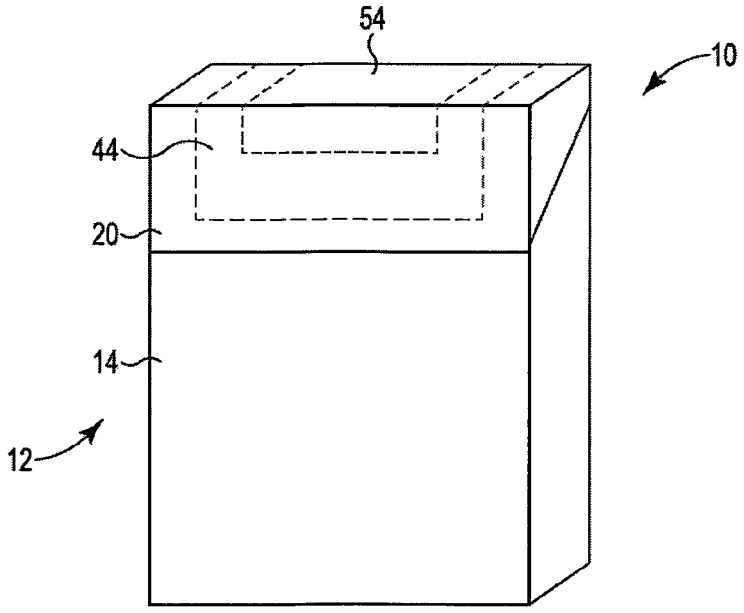
FIG. 3 is a schematic perspective view of the container of FIG. 1 with the lid in a closed position.
Figure 4:
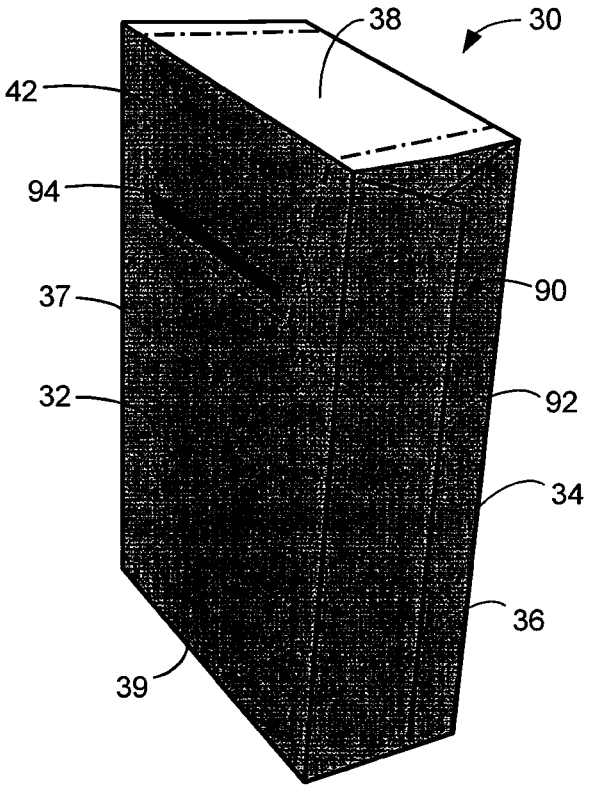
FIG. 4 is a schematic perspective view of the inner package of FIG. 1.
Figure 5:
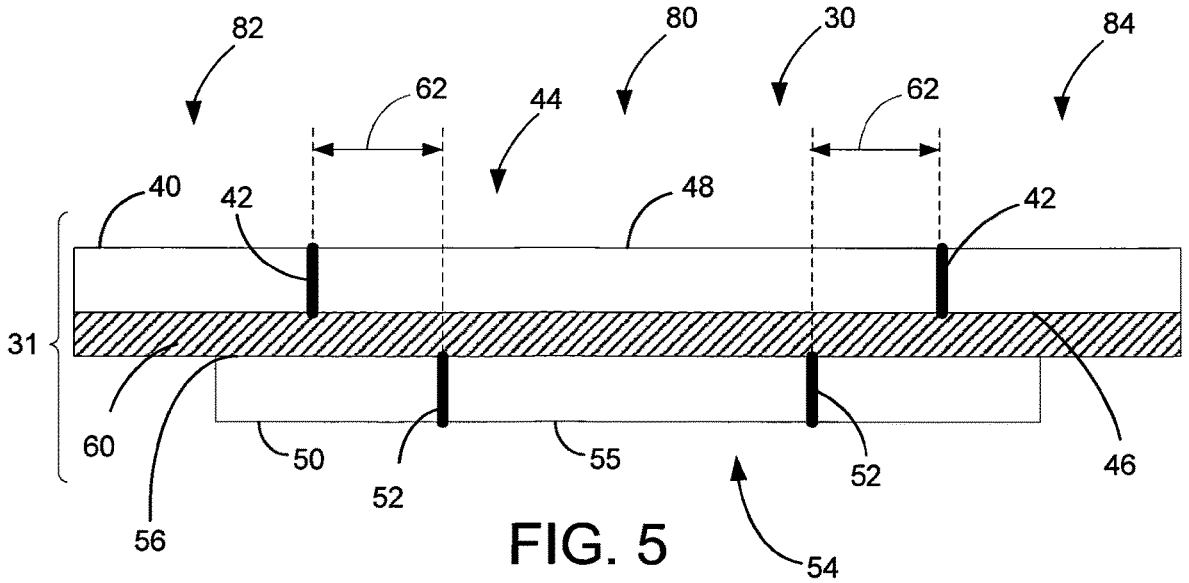
FIG. 5 is a schematic cross-section view of a portion of the inner package of FIG. 1.
Figure 6:
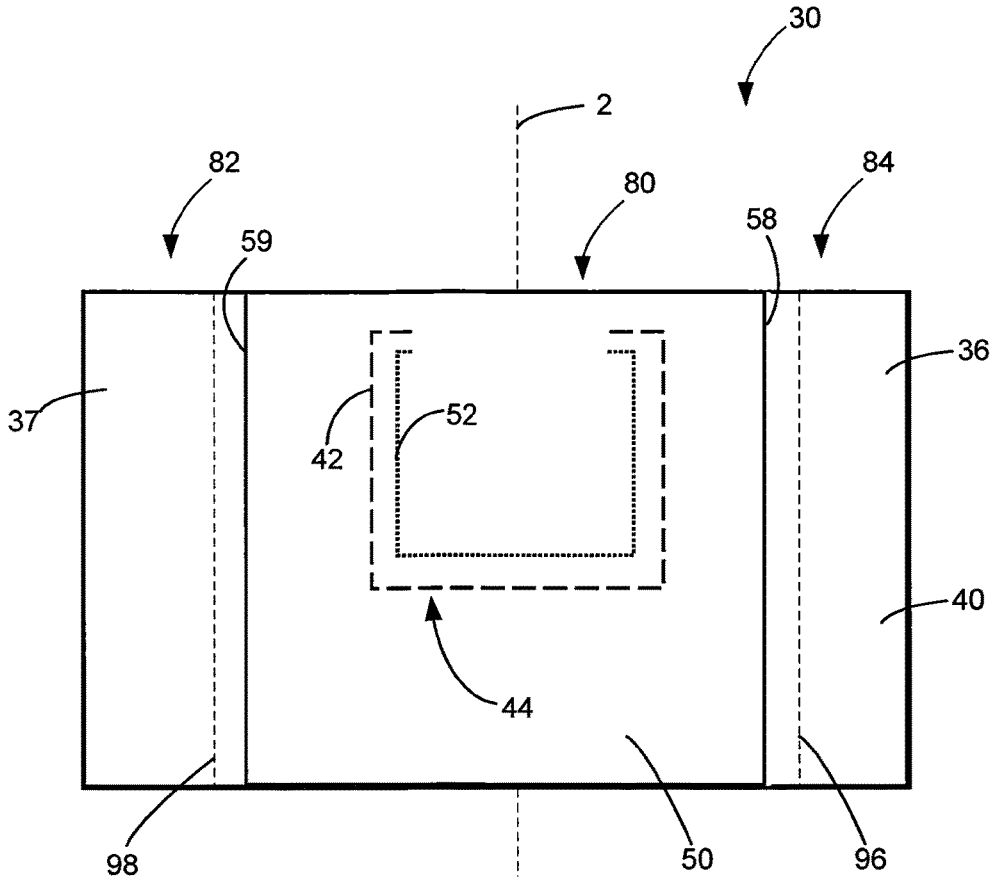
FIG. 6 is a schematic plan view of a portion of the inner package of FIG. 1.

Referring to FIGS. 4-6, the inner package 30 includes a top wall 38, bottom wall 39, front and back walls 32, 34 that extend between the top and bottom walls, a first side wall 36, and a second side wall 37, where each side wall is disposed between the front and back walls. The inner package 30 is formed from a material 31 that includes a first layer 40 and a second layer 50 attached to an inner surface 46 of the first layer 40 (FIG. 5). As illustrated in FIGS. 5-6, the inner package 30 also includes a first region 80 that extends along a longitudinal axis 2. The first region 80 includes the first and second layers 40, 50 of the material 31. The first region 80 also includes a first line of weakness 42 disposed in the first layer 40 that defines a flap 44. The first region 80 also includes a second line of weakness 52 disposed in the second layer 50 that defines an access opening 54 disposed in the first region through which the consumer goods (not shown) can be removed. The access opening 54 is covered by the flap 44 when the flap is in the closed position (FIG. 3). Further, the access opening 54 is at least partially uncovered when the flap 44 is in the open position (FIGS. 1-2).

The inner package 30 also includes a second region 82 adjacent the first region 80 that extends along the longitudinal axis 2. The second region 82 includes only the first layer 40 and not the second layer 50. The inner package 30 also includes a third region 84 adjacent the first region 80 such that the first region is disposed between the second region 82 and the third region 84. The third region 84 also extends along the longitudinal axis 2. The third region 84 includes only the first layer 40 and not the second layer 50.

Figure 2:
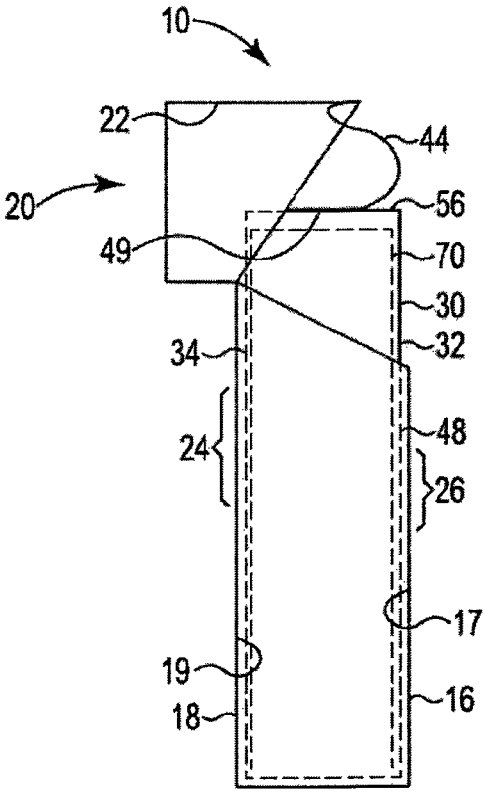
FIG. 2 is a schematic side cross-section view of the container of FIG. 1.

The flap 44 is attached to the first layer 40 along a hinge line 49 (FIG. 2). The flap 44 is also attached to an inner surface 22 (FIG. 2) of the lid 20 such that upon opening the lid the flap and a portion 55 (FIG. 1) of the second layer 50 attached to the flap are separated from the inner package 30 along the first and second lines of weakness 42, 52 respectively to reveal the access opening 54.

The container 10 also includes an inner frame 70 disposed within the inner package 30. The inner frame 70 can include a reinforcing element 72 disposed between the inner frame and an inner surface 17 (FIG. 2) of a front wall 16 the box 14.

Referring to FIG. 2, a schematic cross-section view of the container 10 of FIG. 1 is depicted with the lid 20 and the flap 44 in the open position. The inner package 30 is shown disposed within the box 14 of housing 12, and the inner frame 70 is disposed within the inner package. In one or more embodiments, the flap 44 is attached to the lid 20. In the open position, the flap 44 forms an S-shape. The geometry of the container 10 is such that the flap 44 is automatically resealed to the inner package 30 when the flap (and the lid 20) is returned to the closed position.

At least a portion of an outer surface 48 of the first layer 40 of the inner package 30 is permanently affixed to a corresponding portion of an inner surface 19 of the rear wall 18 of the box 14, thereby affixing the inner package to the inner surface of the rear wall of the box in a first region 24. Further, at least a portion of the outer surface 48 of the first layer 40 of the inner package 30 is permanently affixed to a corresponding portion of an inner surface 17 of the front wall 16 of the box 14, thereby affixing the inner package to the inner surface of the front wall of the box in a second region 26. By permanently affixing at least a portion of the inner package 30 to one or both of the front wall 16 and the rear wall 18 of the box 14, the structural resilience of the inner package may be further improved. The inner package 30 may be permanently affixed using, for example, hot melt adhesive, solvent based adhesive, water based adhesive, solvent-free adhesive, pressure-sensitive adhesive, conductive type sealing, and inductive type sealing. In a preferred embodiment, the inner package 30 is permanently attached to the box 14 using a hot melt adhesive.

Referring to FIG. 3, a schematic perspective view of the container 10 of FIG. 1 is depicted. The lid 20 of the container 10 and the flap 44 of the inner package 30 are in the closed position. The flap 44 is attached to the second layer 50 (FIG. 5) when the flap is in the closed position.

Referring to FIG. 4, a schematic perspective view of the inner package 30 of FIG. 1 is depicted. In one or more embodiments, the inner package 30 also includes adhesive 94 disposed on the flap 48 such that the flap can be attached to the inner surface 22 of the lid 20 (FIG. 2). The inner package 30 further includes a sealed portion 90 on the first side wall 36. Although not shown, the inner package 30 can also include an additional sealed portion disposed on the second side wall 37. The sealed portion 90 can be disposed within a fold 92 of the material 31 of the inner package 30 to hold the fold in place. The fold 92 of inner package 30 is an envelope fold. The second layer 50 of the material 31 of the inner package 30 does not extend into the sealed portion 90 (FIG. 6).

Referring to FIG. 5, a schematic cross-section view of a portion of the inner package 30 of FIG. 1 is depicted. The first region 80 of the inner package 30 includes the first line of weakness 42 disposed in the first layer 40 that defines the flap 44. The second layer 50 is attached to the inner surface 46 of the first layer 40 with adhesive 60. The first region 80 includes the second line of weakness 52 disposed in the second layer 50 that defines an access opening 54 disposed in the first region. As shown in FIG. 5, the access opening 54 is covered by the flap 44 when the flap is in the closed position. The flap 44 is adapted to be attached to the second layer 50 when the flap is in the closed position.

A seal region 62 is formed between the first line of weakness 42 and the second line of weakness 52. The flap 44 is adapted to overlap the access opening 54 into the seal region 62 such that the flap attaches to the second layer 50 within the seal region when the flap is in the closed position. In one or more embodiments, the seal region 62 has a constant width along a perimeter of the access opening 54. In one or more embodiments, the seal region 62 has a width that varies along a perimeter of the access opening 54.

The inner package 30 also includes the portion 55 of the second layer 50 that remains attached to the flap 44 when the flap is moved from the closed position to the open position. In other words, upon opening the flap 44 (FIGS. 1-2), the flap and the portion 55 of the second layer 50 attached to the flap are separated from the inner package 30 along the first and second lines of weakness 42, 52 respectively to reveal the access opening 54.

Referring to FIG. 6, a schematic plan view of a portion of the inner package 30 of FIG. 1 is depicted. Fold lines 96 and 98 are formed to provide an envelope fold in both the first and second side walls 36, 37, portions of which being illustrated in FIG. 6. The fold lines 96, 98 can be disposed between the front wall 32 and side walls 36, 37 of the inner package 30, or between the back wall 34 and the side walls. Tabs of the envelope folds (for example, envelope fold 90 of FIG. 4) formed in the first and second side walls 36, 37 can be attached together to form the sealed portion 92 in the first side wall 36 (FIG. 4) and a sealed portion in the second side wall 37 (not shown). In one or more embodiments, a first edge 58 of the second layer 50 does not extend to the fold line 96 in the first side wall 36. Further, a second edge 59 of the second layer 50 does not extend to the fold line 98 in the second side wall 37. As a result, the second layer 50 does not extend into the sealed portions formed when tabs of the envelope fold are attached together in the first and second side walls 36, 37.

Figure 7:
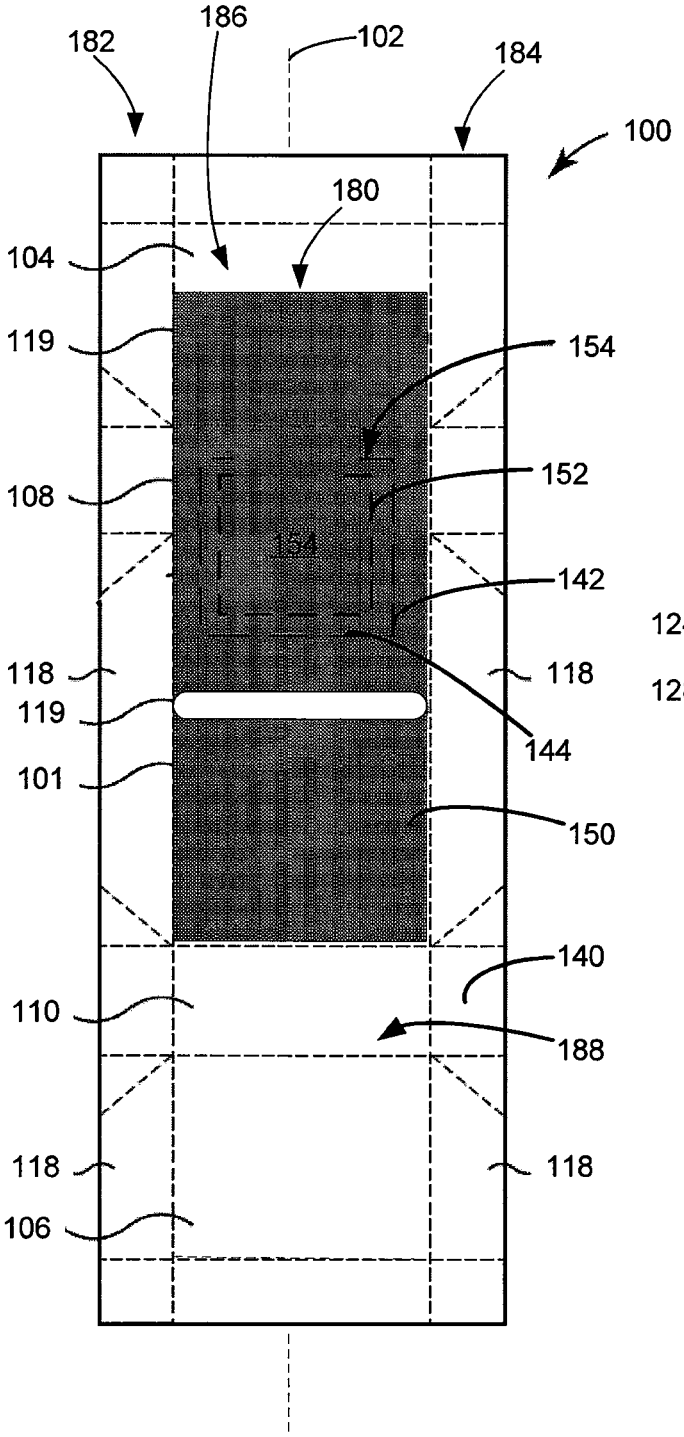
FIG. 7 is a schematic plan view of a pre-assembled inner package.

Referring to FIG. 7, a schematic plan view of a pre-assembled inner package 100 is depicted. The pre-assembled inner package 100 extends along a longitudinal axis 102 and is formed from a material that includes a first layer 140 and a second layer 150 attached to an inner surface of the first layer (not shown). The pre-assembled inner package 100 further includes a first region 180 that extends along the longitudinal axis 102 and includes the first and second layers 140, 150. The first region 180 further includes a first line of weakness 142 disposed in the first layer 140 that defines a flap 144, and a second line of weakness 152 disposed in the second layer 150 that defines an access opening 154 disposed in the first region. The access opening 154 is covered by the flap 144 when the flap is in a closed position, and the access opening is at least partially uncovered when the flap is in an open position. The pre-assembled inner package 100 also includes a second region 182 adjacent the first region 180 that extends along the longitudinal axis 102. The second region 182 includes only the first layer 140 and not the second layer 150. The pre-assembled inner package 100 also includes a third region 184 adjacent the first region 180 that extends along the longitudinal axis 102 such that the first region 180 is disposed between the second region 182 and the third region. The third region 184 includes only the first layer 140 and not the second layer 150.

The first region 180 can longitudinally extend an entire length of the pre-assembled inner package 100. In one or more embodiments, the first region 180 longitudinally extends between a first transverse portion 186 and a second transverse portion 188. Each of the first and second transverse portions 186, 188 includes only the first layer 140 and not the second layer 150.

The pre-assembled inner package 100 shown in FIG. 7 also includes a front wall panel 101 that forms a front wall (for example, front wall 32 of inner package 30 of FIG. 4) of the inner package when assembled, two wall panels 104 and 106 that form a back wall (for example, back wall 34 of inner package 30 of FIG. 4) of the inner package when assembled, a top wall panel 108, and a bottom wall panel 110. The pre-assembled inner package 100 also includes a plurality of side wall panels 118 that form side walls (for example, first and second side walls 36, 37 of FIG. 4). As can be seen in FIG. 7, the second line of weakness 152 is disposed on the pre-assembled inner package 100 such that the access opening 154 is defined across a portion of the top wall panel 108 and the front wall panel 102. The pre-assembled inner package 100 can also include a reinforcing element 119. The reinforcing element 119 can include any suitable reinforcing element described herein regarding the inner frame 70 of FIGS. 1-2.

Figure 8:
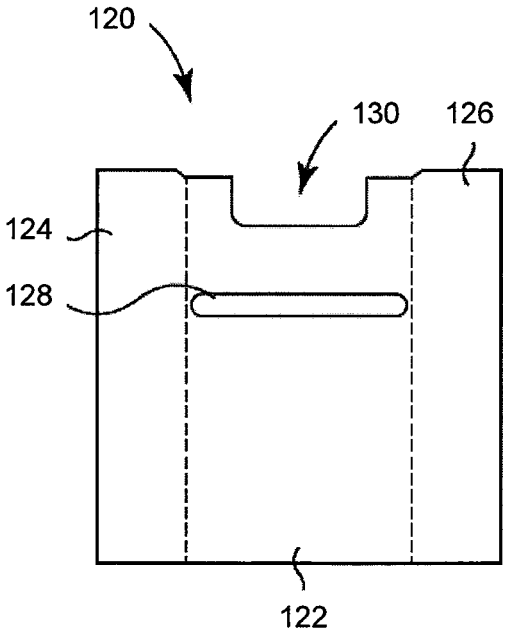
FIG. 8 is a schematic plan view of an inner frame.

FIG. 8 shows the pre-assembled inner frame 120. As described herein, the inner frame 120 includes a front wall 122 and two opposed side walls 124 and 126. The outer surface of the front wall 122 is provided with a reinforcing element 128. As described herein, a cut-out 130 is provided at the top of the front wall panel of the inner frame. The cut-out 130 is provided to allow the consumer goods housed within the container to be accessed more easily. The cut-out 130 is provided such that it aligns with the access opening 54 (FIG. 1) provided in the inner package 30.

The dashed lines in the above described figures indicate fold lines.

The invention claimed is:

1. A container for consumer goods, comprising:

a housing comprising a box and a lid hingedly attached to the box, wherein the box comprises a front wall and a rear wall;

an inner package disposed within the housing and at least partially defining an interior volume for housing the consumer goods, wherein the inner package is formed from a material comprising a first layer and a second layer attached to an inner surface of the first layer, wherein the inner package comprises:

a first side wall, and a second side wall;

a sealed portion in at least one of the first and second side walls disposed within a fold of the material of the inner package;

a first region extending along a longitudinal axis of the inner package and comprising the first and second layers, wherein the first region longitudinally extends an entire length of the inner package when pre-assembled such that the first and second layers in the first region also extend the entire length of the inner package when pre-assembled, wherein the first region further comprises a first line of weakness disposed in the first layer that defines a flap, and a second line of weakness disposed in the second layer that defines an access opening disposed in the first region through which the consumer goods can be removed, wherein the access opening is covered by the flap when the flap is in a closed position, wherein the access opening is at least partially uncovered when the flap is in an open position, wherein the flap is attached to an inner surface of the lid; and a second region adjacent the first region and extending along the longitudinal axis, wherein the second region comprises only the first layer and not the second layer, wherein the second layer does not extend into the sealed portion.

2. The container of claim 1, wherein the flap is attached to the inner surface of the lid such that upon opening the lid the flap and a portion of the second layer attached to the flap are separated from the inner package along the first and second lines of weakness respectively to reveal the access opening.

3. The container of claim 2, wherein the flap is attached to the inner surface of the lid by a permanent adhesive.

4. The container of claim 1, wherein the inner package further comprises a top wall, bottom wall, front and back walls that extend between the top and bottom walls along the longitudinal axis, and the first and second side walls that are each disposed between the front and back walls, the access opening disposed in the first region is defined across a portion of the top wall and the front wall of the inner package.

5. The container of claim 1, wherein the inner package comprises a fold line disposed between the front wall and at least one side wall, and further wherein the second layer does not extend to the fold line.

6. The container of claim 1, wherein the second layer is attached to the inner surface of the first layer by a releasable adhesive.

7. The container of claim 6, wherein the releasable adhesive comprises a pressure-sensitive adhesive.

8. The container of claim 1, wherein the inner package further comprises a seal region formed between the first line of weakness and the second line of weakness, wherein the flap is adapted to overlap the access opening into the seal region such that the flap attaches to the second layer within the seal region when the flap is in the closed position.

9. The container of claim 8, wherein the seal region comprises an average width that extends from a perimeter of the access opening to the first line of weakness, wherein the average width is between about 2 mm and about 5 mm.

10. The container of claim 1, wherein at least a portion of an outer surface of the first layer of the inner package is permanently affixed to a corresponding portion of an inner surface of the rear wall of the box.

11. The container of claim 1, wherein at least a portion of the outer surface of the first layer of the inner package is permanently affixed to a corresponding portion of an inner surface of the front wall of the box.

12. The container of claim 1, further comprising an inner frame disposed within the box, wherein the inner frame comprises a front wall and a pair of opposed side walls.

13. The container of claim 12, wherein:

the inner frame is disposed between the front wall of the box and the inner package; or the inner frame is disposed within the inner package.

14. The container of claim 1, further comprising the consumer goods, wherein the consumer goods are housed in the interior volume defined by the inner package.

15. The container of claim 1, wherein the consumer goods are smoking articles.

16. A carton comprising the container of claim 1.

17. A pre-assembled inner package extending along a longitudinal axis, wherein the pre-assembled inner package is formed from a material comprising a first layer and a second layer attached to an inner surface of the first layer, wherein the pre-assembled inner package comprises:

a plurality of side wall panels that form side walls of an inner package when assembled, wherein at least one of the side walls includes a sealed portion disposed within a fold of the material of the inner package when assembled;

a first region extending along the longitudinal axis and comprising the first and second layers, wherein the first region longitudinally extends an entire length of the pre-assembled inner package such that the first and second layers in the first region also extend the entire length of the pre-assembled inner package, wherein the first region further comprises a first line of weakness disposed in the first layer that defines a flap, and a second line of weakness disposed in the second layer that defines an access opening disposed in the first region, wherein the access opening is covered by the flap when the flap is in a closed position, and further wherein the access opening is at least partially uncovered when the flap is in an open position; and a second region adjacent the first region and extending along the longitudinal axis, wherein the second region comprises only the first layer and not the second layer, wherein the second layer does not extend into the sealed portion.

18. The pre-assembled inner package of claim 17, further comprising a third region adjacent the first region and extending along the longitudinal axis, wherein the first region is disposed between the second and third regions, wherein the third region comprises only the first layer and not the second layer.

19. The pre-assembled inner package of claim 17, wherein the first region has a width measured in a transverse direction of between about 2 mm and about 20 mm.

20. The pre-assembled inner package of claim 17, wherein the second line of weakness is disposed on the pre-assembled inner package such that the access opening is defined across a portion of a top wall panel and a front wall panel of the pre-assembled inner package.

* * * * *